US007774967B1

(12) United States Patent
Jones et al.

(10) Patent No.: US 7,774,967 B1
(45) Date of Patent: Aug. 17, 2010

(54) BANNER DISPLAY ASSEMBLY AND METHOD

(76) Inventors: David Richard Jones, 2704 Lincoln Dr., Arlington, TX (US) 76006; Ronald W Jones, 1905 Clear Creek Dr., Weatherford, TX (US) 76087

( * ) Notice: Subject to any disclaimer, the term of this patent is extended or adjusted under 35 U.S.C. 154(b) by 290 days.

(21) Appl. No.: 12/156,489

(22) Filed: Jun. 2, 2008

Related U.S. Application Data

(60) Provisional application No. 60/963,994, filed on Aug. 8, 2007.

(51) Int. Cl.
*G09F 17/00* (2006.01)

(52) U.S. Cl. ..... 40/604; 40/518

(58) Field of Classification Search ..... 40/603, 40/604, 590, 790, 518, 471; 160/241, 25, 160/85
See application file for complete search history.

(56) References Cited

U.S. PATENT DOCUMENTS 2,952,931 A * 9/1960 Manduca ..... 40/518
6,594,932 B2 * 7/2003 Hurst et al. ..... 40/603

* cited by examiner

*Primary Examiner*—Joanne Silbermann
(74) *Attorney, Agent, or Firm*—Jeffrey Roddy

(57) ABSTRACT

A rectangular banner display assembly for the rapid installation and replacement of ad banners having a frame with two horizontal members both of which are built of extruded segments with channels along which a pre-rolled banner is slid into position during installation. The frame includes a member supportive of a spindle over which the pre-rolled banner is placed and from which the banner is drawn longitudinally. A vertical end-cap with a hinge-able flap partially occludes the member supportive of a spindle while in a closed position, but is opened to access the spindle. A second vertical end cap with a hinge-able flap is opened to expel a banner to be replaced. A method of quickly replacing a previously installed ad banner with a new ad banner by taping the leading end of a new banner with the trailing end of previously installed banner is disclosed. While expelling the previously installed ad banner out the end of the banner display assembly, the new ad banner is drawn along to take its place.

17 Claims, 11 Drawing Sheets

24
10t'
14
20
16
13
24b
26
10c'
26b
16b
22
14
10b'

10t'
14
16
20
NEW
BANNER
13
26
25n
24b
10c'
26b
14
24
10b'
22
16b

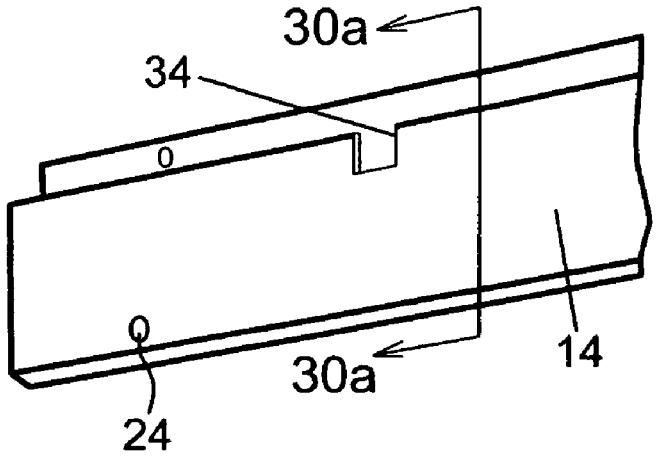
FIG. 11
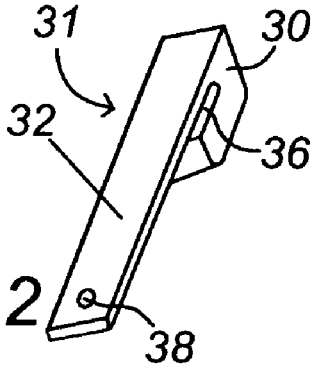
FIG. 12
FIG. 13
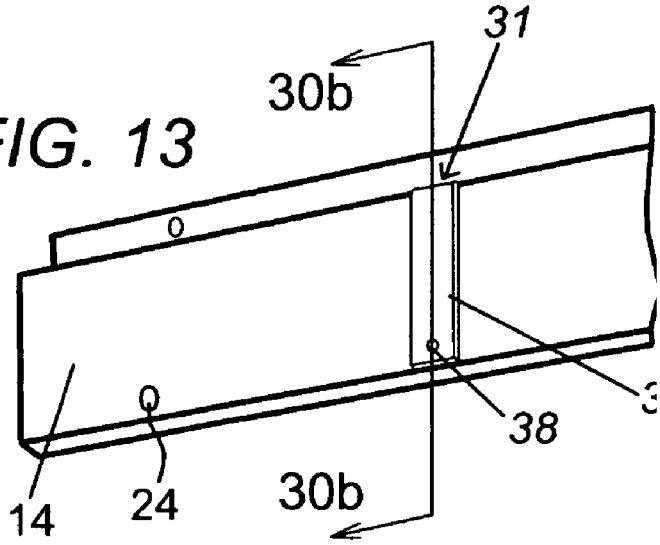

FIG. 18
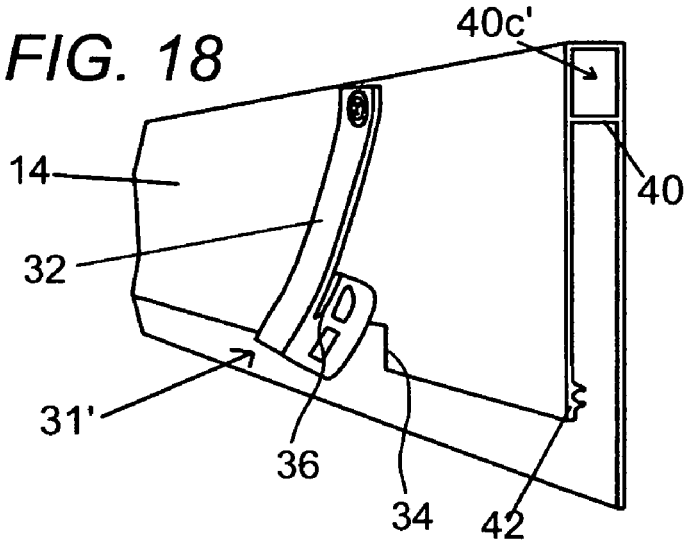
FIG. 19
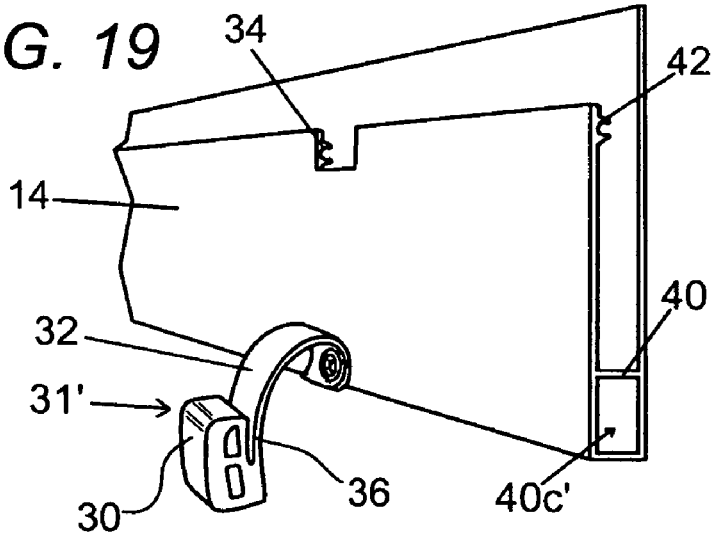
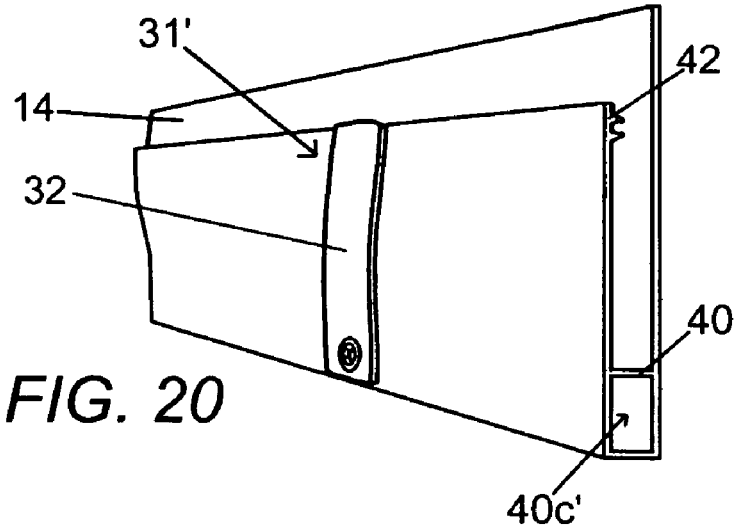
FIG. 20

FIG. 25
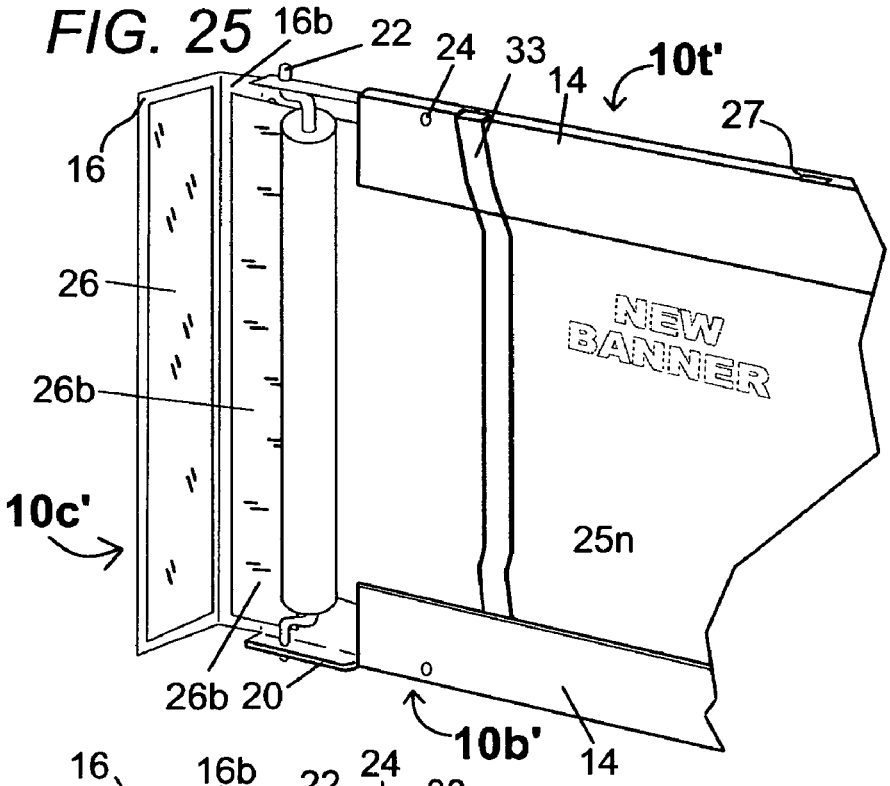
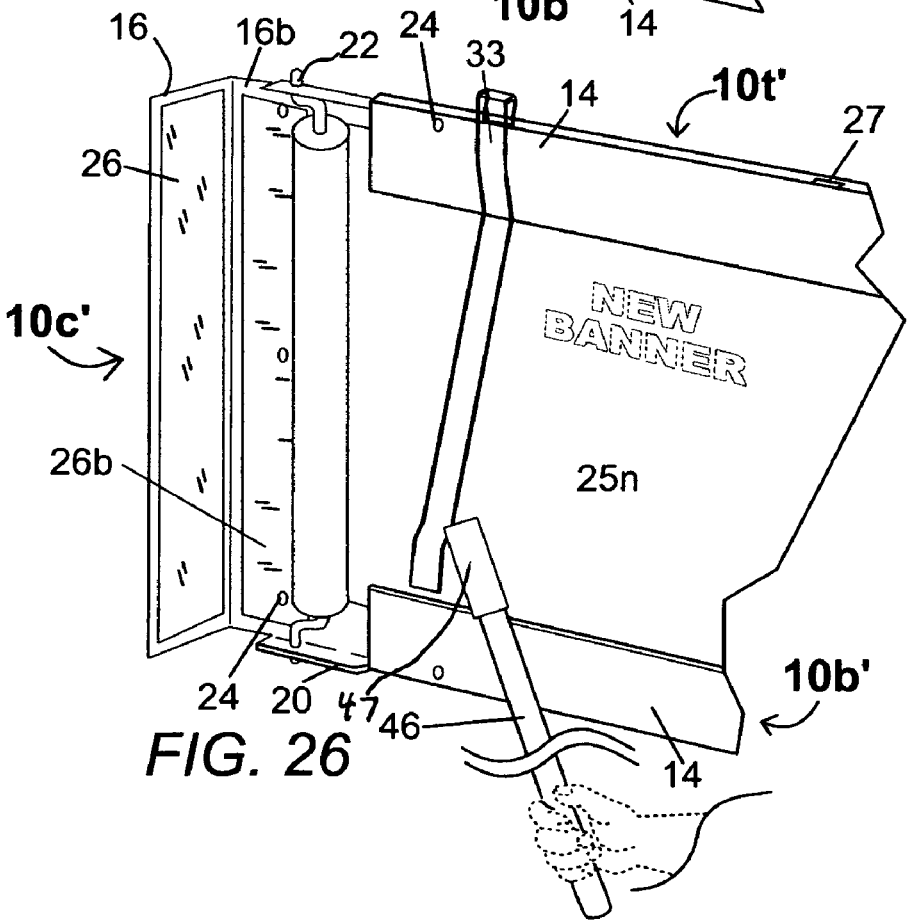
FIG. 26

BANNER DISPLAY ASSEMBLY AND METHOD

CROSS REFERENCE TO RELATED APPLICATIONS

This application claims the benefit of U.S. Provisional Application No. 60/963,994 filed Aug. 8, 2007.

STATEMENT REGARDING FEDERALLY SPONSORED RESEARCH OR DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

The present invention is directed generally to holders for banners and signs and especially those suited for the rectangular type of long advertising banners. Display banners are frequently supplied in sections with registration marks so that they are taped together during the installation process normally within a banner holder having the outward appearance of a four sided frame, but incorporating unexposed elements to secure the banner. Banners may be changed frequently due merchandising demands.

Common objectives of most banner holders and displays are:

Securing the banner against wind damage, puckering and tearing that is possible with an outdoor display exposed to the elements, and facilitating the exchange of banners by making the replacement process relatively straightforward for employees. To a degree, the aforementioned objectives are met by previous banner holders; however, all involve risk of injury because much of the time spent installing a new banner is performed on a ladder often situated in the entryway of the establishment.

Designs the previous banner holders resulted from an uneven compromise between the aforementioned objectives. For example, measures commonly taken to design a banner holder that optimize resistance to wind often result in a complicated arrangement of brackets and tensioners that resist the easy removal and insertion of banners and increases the time spent on a ladder to install or replace a banner. Additionally, having to piece together and properly register a multi-part banner making sure the banner evidences no breaks in visual continuity at the point of display can be difficult and time consuming.

Some banner holders also require customization of the banner by the addition of stiffeners and holes about the banner edges that would naturally increase the cost of the advertising media, and require implementation by the banner supplier who is likely a different party than the maker of the banner holder; in others, the tensioning means raises the banner away from the surface on which the holder frame is mounted increasing the likelihood of rapidly spreading tears because the banner is stretched by the tensioners.

What is needed is an advertising banner display system that requires minimal alteration of the display media having it supplied pre-taped into a rolled form to obviate the need for on-site registration, while offering securement of the advertising banner, resistance to damage by the elements and providing a more safe, intuitive and expeditious installation process.

SUMMARY OF THE INVENTION

The instant invention proposes to overcome the deficiencies of existing designs and makes it possible to install typical rectangular ad banners easily while retaining the banner securely even in strong winds. Extruded segments having a inner channel within for the longitudinal travel of the top and bottom edge of an ad banner are placed end to end and attached to a surface—frequently a building storefront; to form the top and bottom rails of a frame. Additional elements also attached to the surface; a vertical frame member supportive of a spindle, and two end-caps complete the frame to define a rectangular display area. At one end of the banner display assembly used to load a banner, hereinafter referred to as the loading end, is a first vertical end-cap with a flap portion and a base portion in a hinge-able relationship to one another. Separating the base and flap portions of the vertical end-cap exposes the vertical frame member supportive of a spindle, whereupon a banner roll is placed over the spindle. The banner is drawn out longitudinally following the inner channel of the top and bottom rails. At the opposite end, hereinafter referred to as the unloading end, is a second vertical end cap of identical construction to the first that while in closed position with flap and base together, secures an ad banner between. Separation of the base and flap portions of the second end-cap exposes the inner channels of the extruded segments and a banner requiring replacement is longitudinally drawn out free of the frame following the channels and discarded.

The banner display assembly uses a variety of means to inhibit the banner from moving within the frame once installed; among these are the two vertical end-caps having a base portion and flap portion hinge-ably connected that are maintained in a closed position by a magnetized strip adhered to the inner surface of the base portion, and a metallicized strip adhered to the inner surface of the flap portion. Preferably the magnetized strip and metallicized strip are rubberized and are commonly available in roll form from suppliers such as Dura Magnetics Inc. of Sylvania, Ohio. However it is conceivable that the magnetized strip may be rubberized while the metallicized strip may be a magnetically attractive metal, the purpose being to secure the banner in a sandwich fashion between the flap and base portions of the vertical end-caps with sufficient friction to discourage slippage.

A number of retention members, the purpose of which is to prevent blousing and creeping of the banner, are described herein and are transversely mounted to the top and bottom rails in fixed positions or are manually dislocateable residing in either an active position occupying one of the regularly spaced notches or slots placed along the top and bottom horizontal rails whereby they apply pressure to the banner against the horizontal rails or the surface to which the banner display assembly is attached, or an inactive position being dislocated from a notch or slot thus allowing for the insertion and replacement of a banner. Retention members for the display banners described herein are transversely mounted fixed clips, transversely mounted dislocateable clips and dislocateable flexible cleats. Depending on the type of retention member, it may apply pressure to the banner against the horizontal rails or the surface to which the banner display assembly is attached.

Relatedly, the present invention also provides for a novel method to replace an existing banner by taping the trailing end of an old banner to the leading end of a new banner once a new banner roll has been placed over the spindle. The new banner is installed by opening the end-cap flap at the unloading end of the banner display assembly and pulling the old banner free of the banner display assembly causing the new banner to slide into place of the old banner effectively installing the new banner in one motion. The tape is then removed and the old banner discarded.

Notable advantages for the store owner or operator are the labor savings in time spent in the frequent loading and unloading of banners, a safer work environment due to reduced time spent on a ladder, superior retention of the banner and the low profile design that blends into the store background.

One object of the present invention is to provide a means of rapid insertion, removal and replacement for banner ads in a banner display assembly.

Another object of the present invention is to provide a banner display assembly which will be less cumbersome to operate and therefore much safer for employees and customers.

Still another object of the present invention is to provide an unobtrusive banner display assembly having a unobtrusive design that does not interfere with the viewing experience associated with a display.

Yet another object of the present invention is to so simplify the process of banner insertion as to reduce the time the installer has to spend on a ladder, potentially in a high consumer traffic area.

The description as follows is not intended to limit the scope of the invention to the particular embodiments set forth, but on the contrary, it is intended to cover such alternatives, modifications, and equivalents as may be included within the spirit and scope of the invention as defined by the appended claims.

BRIEF DESCRIPTION OF THE DRAWINGS

FIG. 3 is a partial perspective view showing an open end-cap at the loading end of the banner display assembly with bare spindle 22, and building surface 13 showing through;

FIG. 11 is a partial view of one embodiment of a section of extruded segment with notches 34;

FIG. 12 is a perspective view of a flexible retention cleat 30;

FIG. 13 is a partial view of one embodiment of a section of extruded segment showing a flexible retention cleat placed fitted in notch 34 of FIG. 11;

FIG. 17*b* is partial plan view of two extruded segments placed end to end having a gap 44 between;

FIG. 18 is a partial perspective view of a section of extruded segment with flexible retention cleat 30 attached;

FIG. 19 is a partial perspective view of a section of extruded segment with flexible retention cleat 30 attached;

FIG. 20 is a partial perspective view of a section of extruded segment with flexible retention cleat 30 attached and fitted into notch 34 (FIGS. 18,19)

FIG. 25 is a partial perspective view showing the banner installation end-cap of the banner display and a dislocateable retention clip 33 in place;

FIG. 26 is a partial perspective view showing the banner installation end-cap of the banner display and a dislocateable retention clip 33 pushed up and out of contact with a banner by a pole tool 46;

DETAILED DESCRIPTION OF THE EMBODIMENTS

Terminology

The term dislocateable retention cleat(s) refer to generally 'P' shaped deformable inserts that when engaged, press against an ad banner preventing slippage and wrinkling, but when disengaged, allow an ad banner longitudinal movement.

The term fixed retention clip(s) refer to fixed transparent straps having terminal ends that are transversely mounted relative to the horizontal rails and are raised slightly above the surface of an ad banner requiring no repositioning prior to banner insertion or removal.

The term dislocateable retention clip(s) refer to bowed, releasable flexible transparent straps transversely mounted relative to the horizontal rails having an curled head and tang and a tail end where the tang is inserted into any one of regularly spaced notches along the top edge of the top horizontal rail and the tail end is slid between the outer facing lip of the lower horizontal rail and the banner to apply pressure to and retain the banner securely against the mounting surface thus preventing slippage and wrinkling.

The term pre-registered banner roll and banner roll are herein used interchangeably and refer to a roll requiring no piecing together at the point of display. It may be a unitary banner of paper or synthetic/plastic construction, or a multi-part banner where the sections have been pre-registered and affixed together by taping or gluing having visual continuity.

The banner display assembly is constructed of a few elements shown in FIGS. 7-10; the banner display assembly 10' is shown as a rectangular frame above the entryway of a storefront, the nominal outer dimensions being 18 inches×26 feet to accommodate a standard sized banner; however, it may be scaled up or down as needed depending on the number of extruded segments 14 (FIG. 10) used to build the top 10*t*' and bottom 10*b*' rails.

Figure 8:
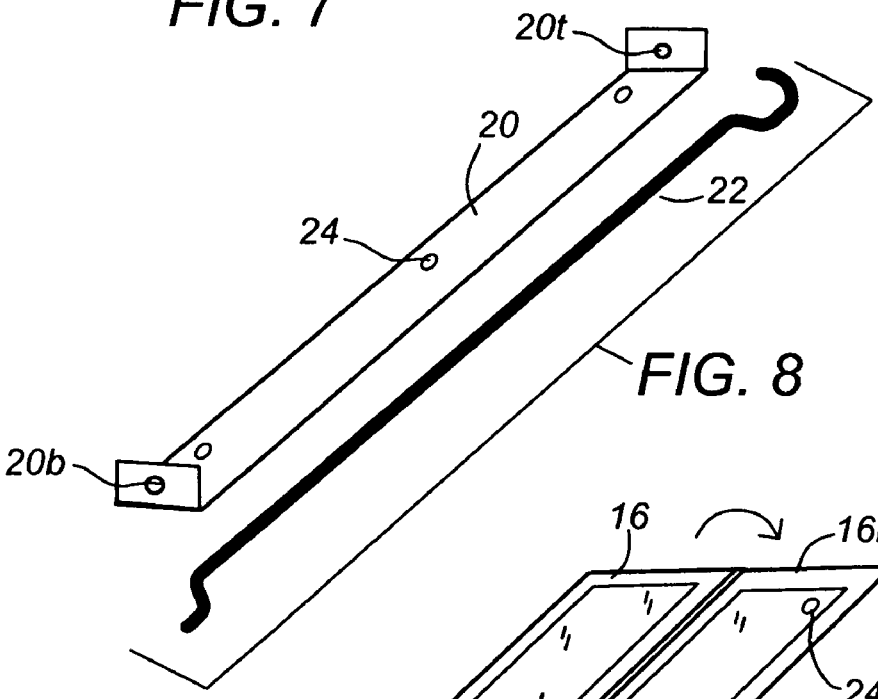
FIG. 8 is a perspective view of the vertical frame member 20 and spindle 22 sub-assembly.
Figure 9:
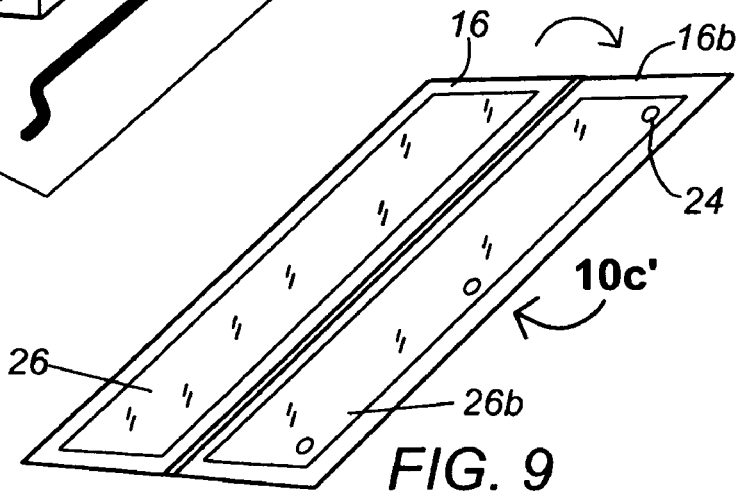
FIG. 9 is a perspective view of the banner end-cap sub-assembly 10*c';*
Figure 10:
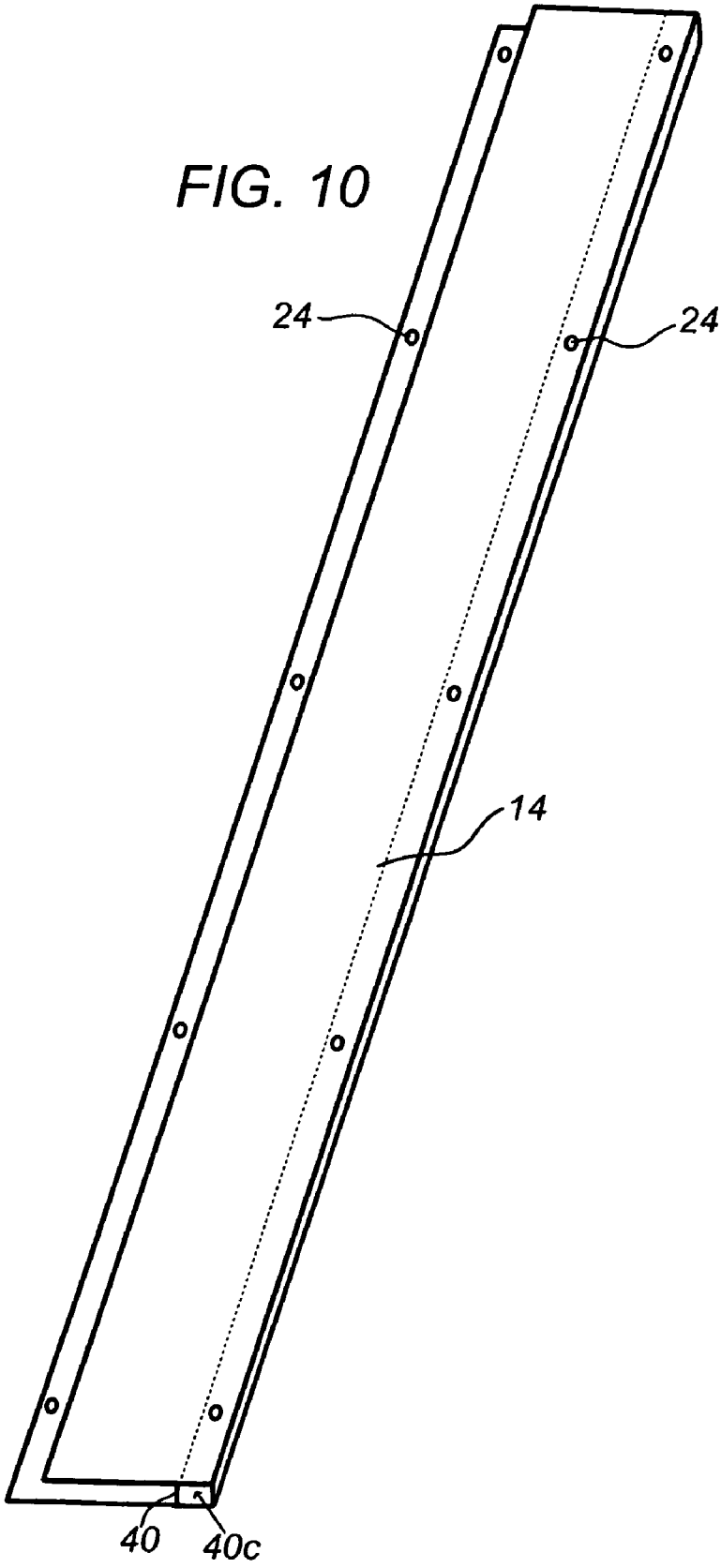
FIG. 10 is a perspective view of a single extruded segment 14.

FIG. 8 shows a vertical frame member 20 supportive of a spindle 22 that serves to retain and dispense a rolled banner. The vertical frame member supportive of the spindle may take the form of a vertical frame member with two opposing arms having apertures to receive the distal ends of the spindle, or conceivably, the spindle and vertical frame member may be molded or welded together with the top end of the spindle being accessible without having to remove the spindle from the vertical frame member. Two reversible co-extruded end-caps 10*c*' with opposing flaps 16, 16*b* form both vertical ends of the banner display assembly 10'.

Referring to FIGS. 1-26; the top and bottom rails 10*t*', 10*b*' of the banner display assembly are made up of equal numbers of individual extruded segments 14 laid end to end where each extruded segment is attached to a surface 13 which can be any typical material used in buildings such as concrete, aluminum panel, vinyl and wood. Fastener positioning apertures 24 are spaced regularly along the length of the extruded segments, the vertical frame member supportive of the spindle and the base portion 16*b* of both end-caps and are large enough to accommodate various fasteners; screws, molly bolts, concrete anchors, depending on the surface. The extruded segments 14 have the same extruded profile and a c-shaped joining channel 42 running longitudinally along each segment. The purpose of the c-shaped joining channel is for the reception of a joining member 43, preferably a metal pin 3 inches in length that is used as an alignment aid during the attaching of the horizontal rails to a surface 13 and to maintain the segments in alignment relative to each other during periods of thermal expansion and contraction which normally occurs with exterior installations. Because of reduced cost the extruded segments and end-caps are preferably made of vinyl, although conceivably they may be of aluminum or other suitably durable material able to withstand exterior applications.

Once the top and bottom rails 10*t*', 10*b*' are in place, a vertical frame member 20 supportive of a spindle 20 and spindle 22 together with one of two identical co-extruded end-cap sub-assemblies 10*c*' is attached vertically, abutting the rails on the loading end of the banner display assembly. The distal ends of the spindle 22 each have an bend; an 'S' bend for the bottom of the spindle and a curled bend for the top of the spindle so that after the insertion in the two apertures 20*t*, 20*b* at the ends of the vertical frame member, the spindle may be pushed upwardly freeing the lower bend of 20*b* whereupon a pre-registered banner roll is placed over the spindle and the spindle bend replaced back into the aperture. A second vertical end-cap is attached vertically abutting the rails at the unloading end; normally the right hand side of the banner display assembly.

Preferably, each of the two vertical end-caps 10*c* have a vinyl co-extruded base portion 16*b* and flap portion 16 where the base has apertures for the positioning of fasteners that coincide with the apertures on the vertical frame member 20, and is connected to the flap portion by a spine of flexible vinyl serving as a living hinge. In practice, the base and flap pairs are able to be folded together so that a banner is held securely between. Each base and flap pair are releasably held in a closed position by a magnetized strip 26 bonded to the inner surface of the flap 16 and a metallicized strip 26*b* bonded to the inside surface of the base 16*b*. While the end-caps are shown of co-extruded vinyl because of cost benefits, there are other materials that could operate sufficiently such as a rigid thermoplastic and aluminum, and a piano type hinge could conceivably be substituted for the living hinge shown.

Figure 3:
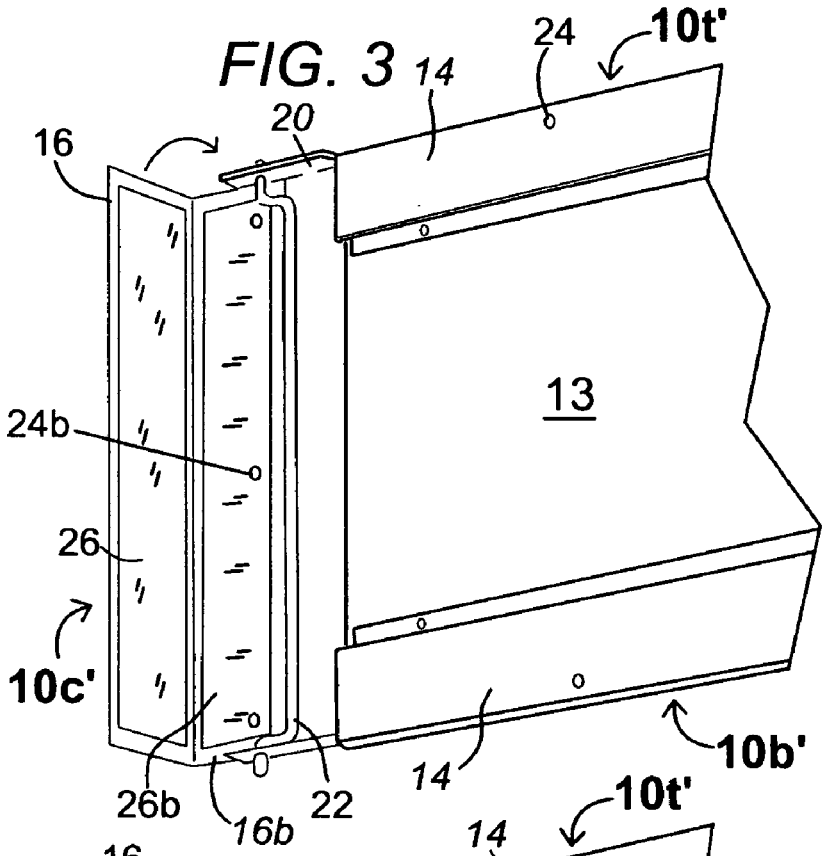
Figure 16:
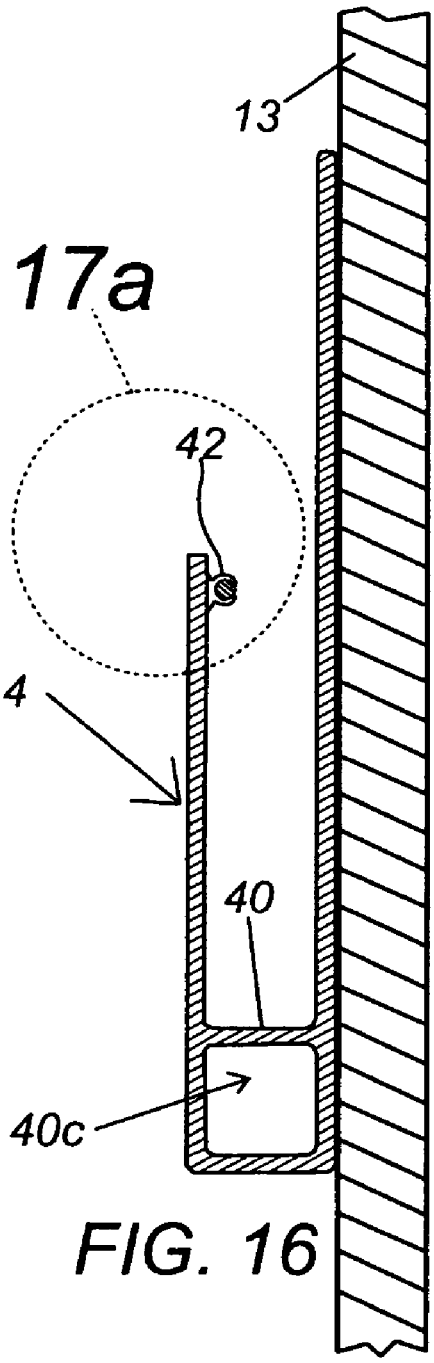
FIG. 16 a sectional view of a section of extruded segment taken along lines 30*b*-30*b* of FIG. 13.
Figure 17A:
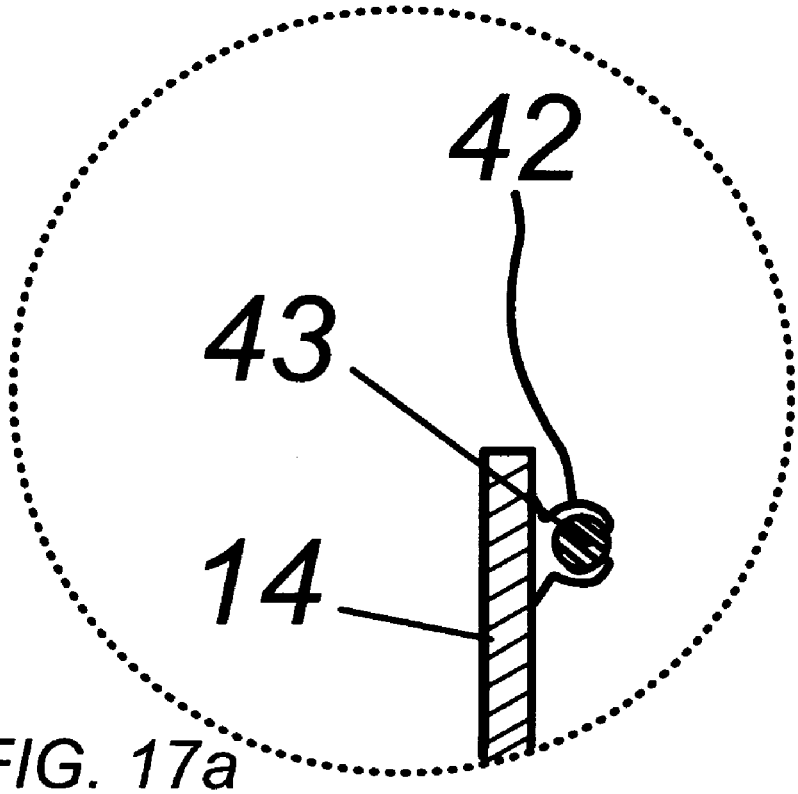
FIG. 17*a* is a detail view of a 17*a* (FIG. 16)
Figure 17B:
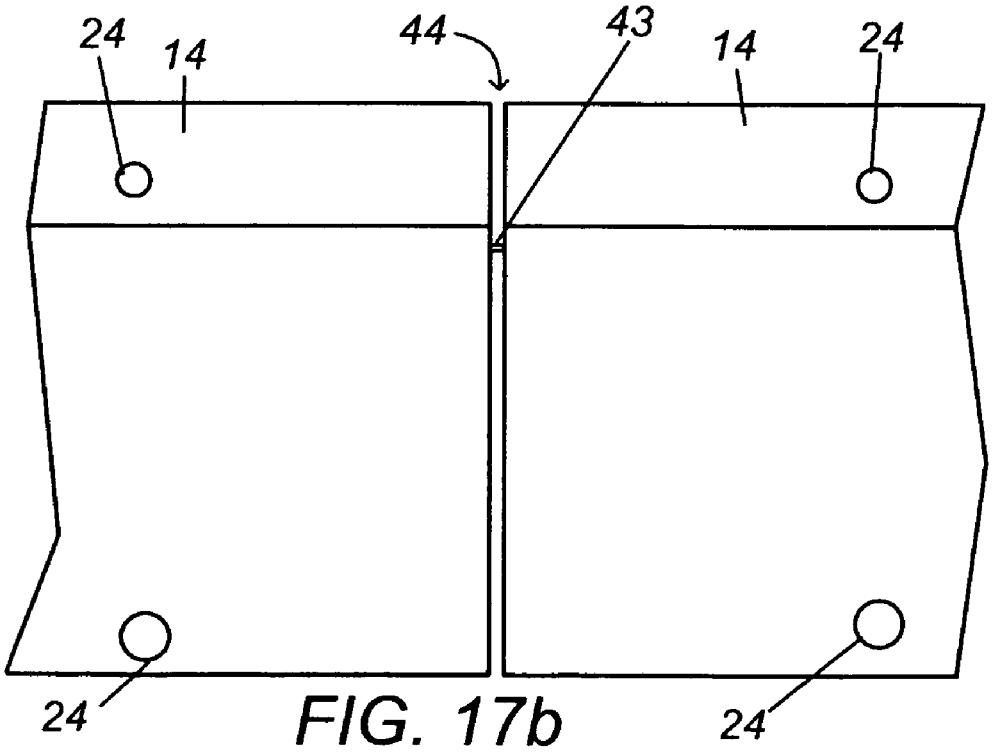
Figure 21:
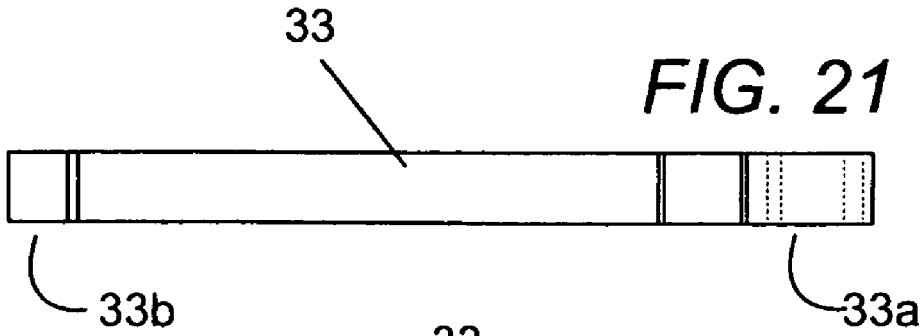
FIG. 21 is a plan view of a moveable retention clip 33.
Figure 22:
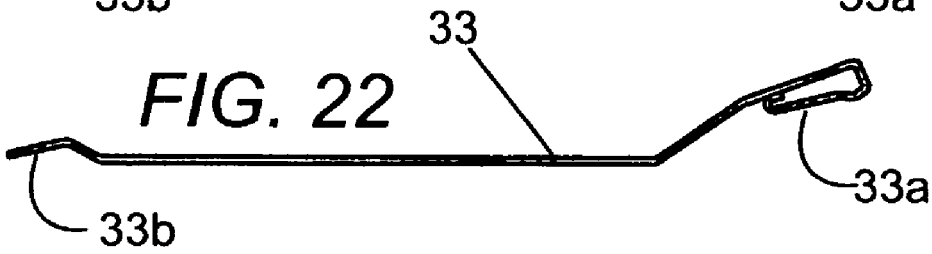
FIG. 22 is a side elevation of a moveable retention clip 33.
Figure 23:
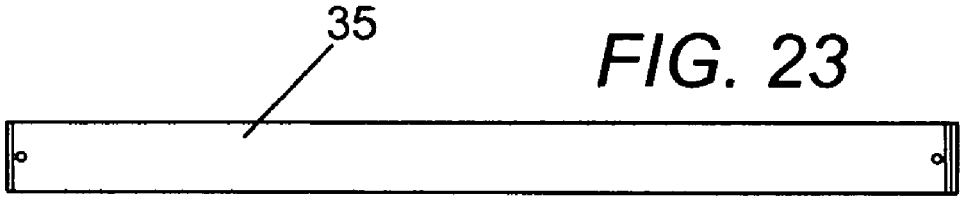
FIG. 23 is a plan view of a fixed retention clip 35.
Figure 24:
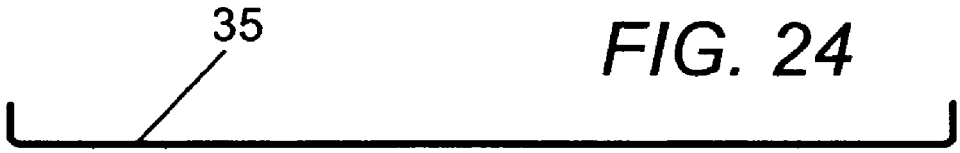
FIG. 24 is a side elevation of a fixed retention clip 35.

FIG. 3 shows a co-extruded end-cap flap 16 in open position revealing the vertical frame member 20 and spindle 22 at the banner loading end of the present invention. Horizontal rails 10*t*', 10*b*' are made of vinyl extruded segments 14 laid end to end, where the segments have preferably a 'J' shaped profile with the shorter width facing outward; however, it is conceivable that the segments may be made of extruded aluminum or other durable weather resistant material. A detail of extruded segment 14 is shown in FIG. 16 being substantially "J" shaped outwardly, and being divided internally and longitudinally by a divider 40 creating an additional enclosed channel 40*c* adjacent to 40. The face of divider 40 provides a smooth surface for a banner edge to move along longitudinally without obstruction because it segregates the banner edge from fasteners which are placed through fastener positioning apertures 24 entering into the enclosed channel 40*c* in order to fasten the extruded segments to a mounting surface. The enclosed channel also provides additional rigidity and reinforcement to the extruded segments. An internal and longitudinal c-shaped joining channel 42 for the insertion of an joining member 43 that bridges gap 44 (FIG. 17) between extruded segments, allows the segments to expand and contract while maintaining alignment relative to each other so as to provide a smooth, unobstructed path for the longitudinal travel of a banner edge within the horizontal rails.

Figure 2:
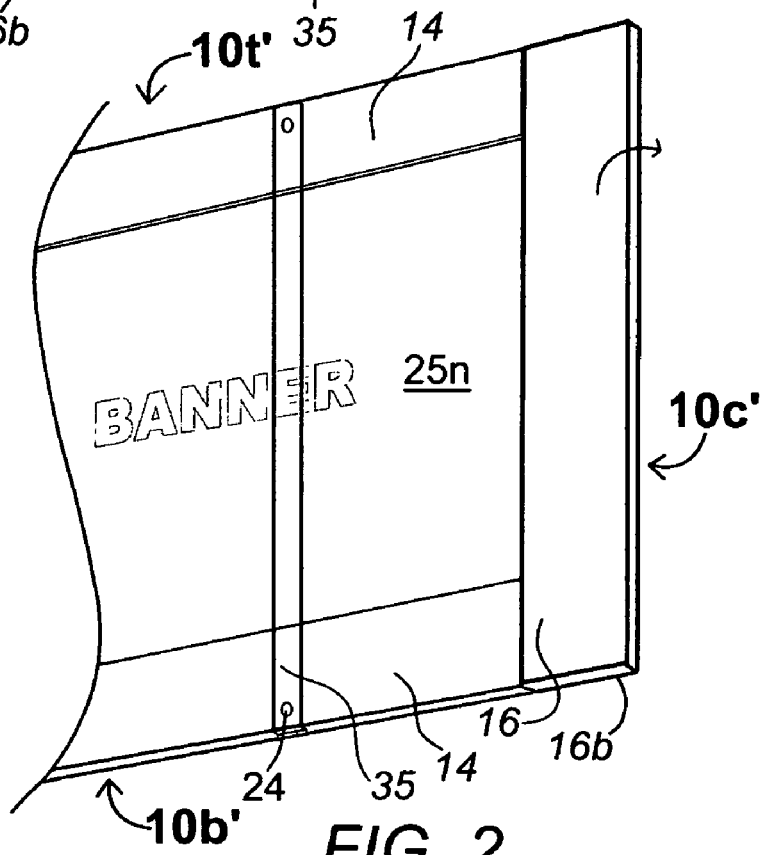
FIG. 2 is partial perspective view of the unloading end of the banner display assembly and a continuation of FIG. 1.
Figure 4:
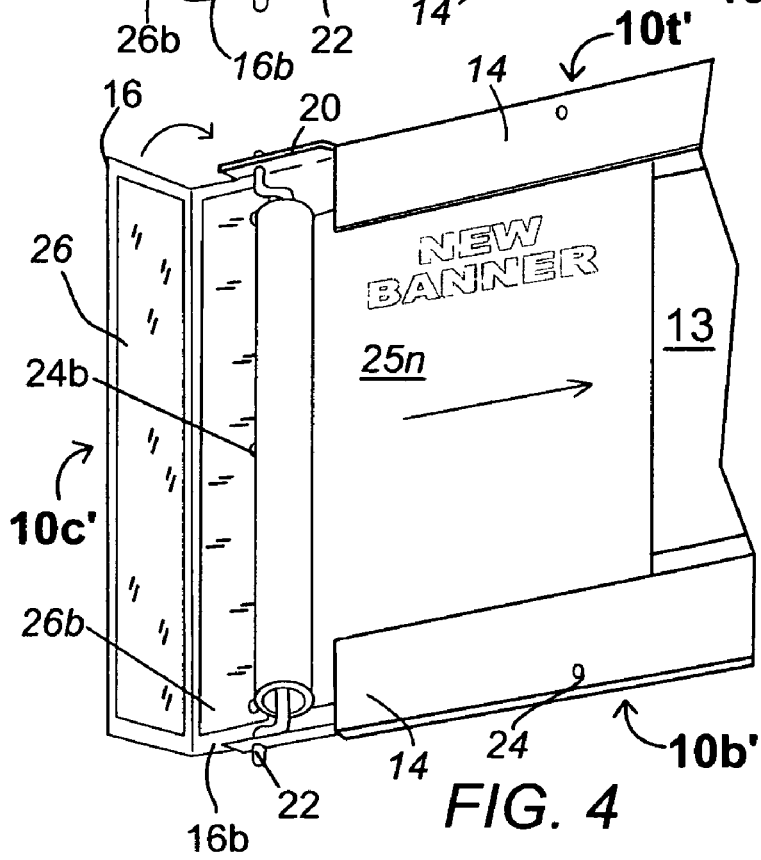
FIG. 4 is a partial perspective view showing an open end-cap at the loading end of the banner display assembly with a banner roll fitted over spindle 22.

FIG. 4 illustrates the installation of a new banner by placing a banner roll 24 over the spindle 22 and drawing the new banner 25*n* along the continuous channel of the horizontal rails of the banner display assembly until the leading edge of the banner abuts the right side end-cap 10*c* as in FIG. 2.

Figure 5:
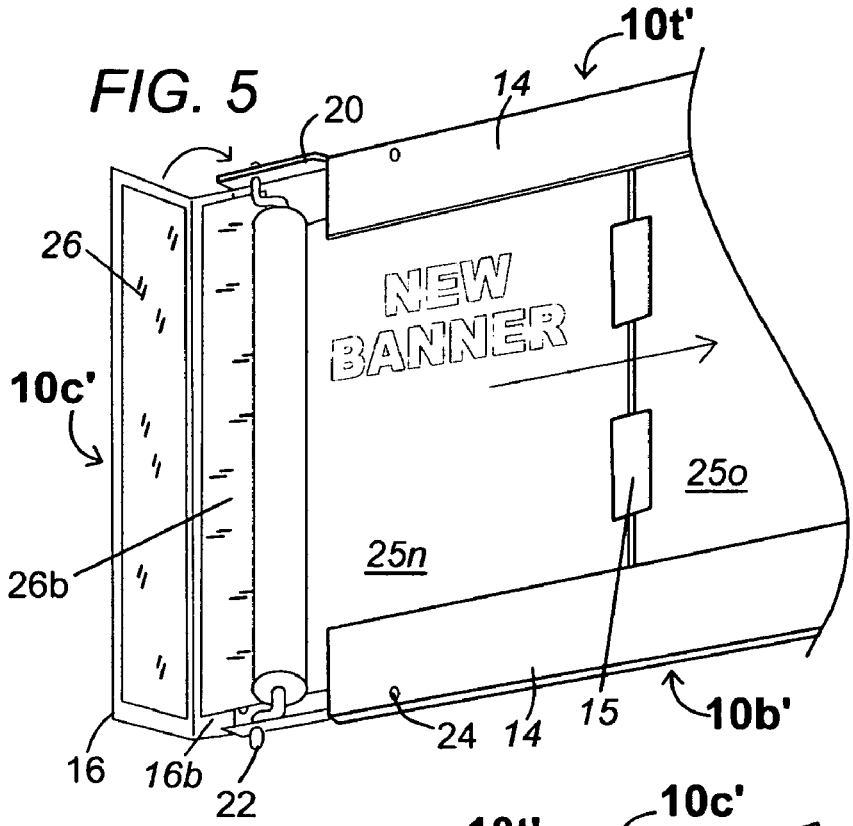
FIG. 5 is a partial perspective view of the loading end of the banner display assembly r showing a removal step for uninstalling an old banner 25*o* by taping it to a new banner 25*n;*
Figure 6:
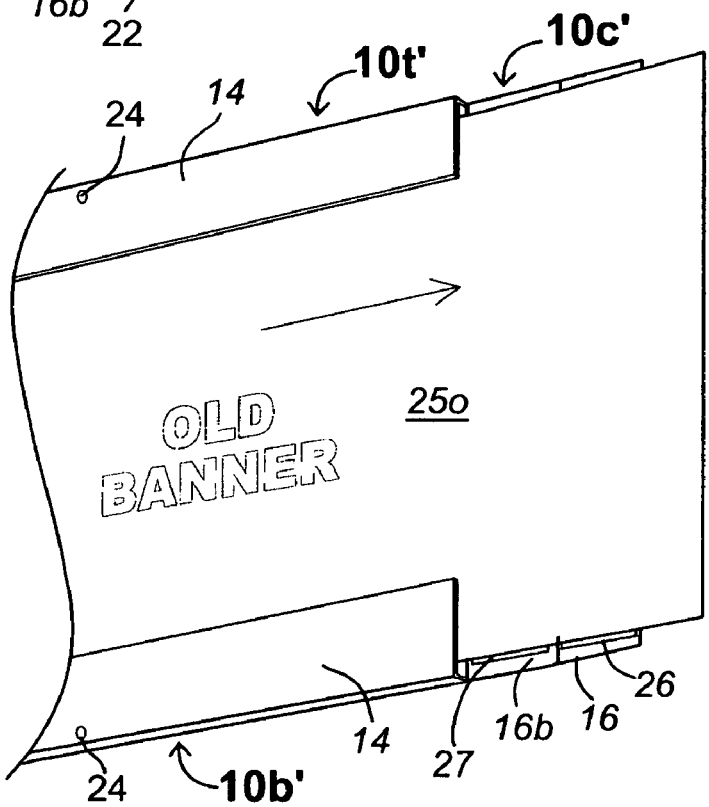
FIG. 6 is a partial perspective view that is a continuation of FIG. 5 showing the open end-cap at the unloading end of the banner display assembly and old banner 25*o* being pulled longitudinally free of the banner display assembly.
Figure 7:
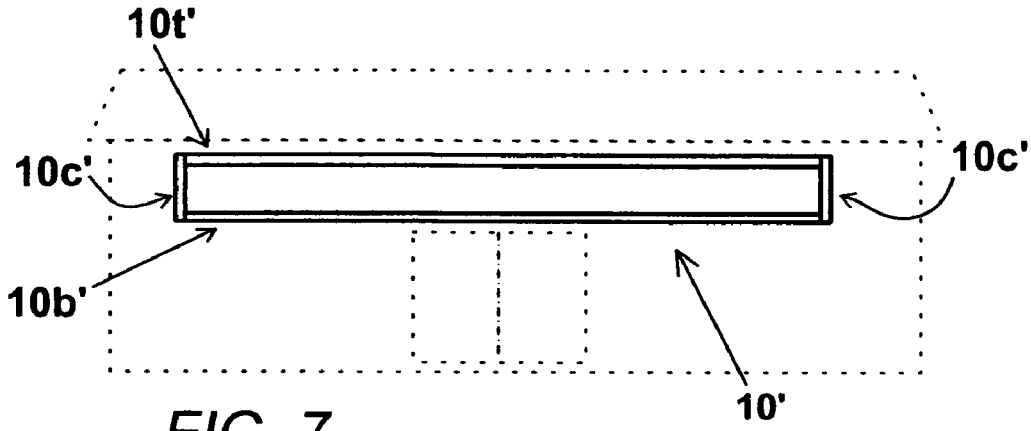
FIG. 7 is a front elevation of a storefront with banner display assembly installed over the entryway, representing one non-limiting example of the instant invention in typical use. Shown also are the end-cap sub-assemblies 10*c*' and the top rail and bottom rail 10*t*' and 10*b*' respectively.

FIGS. 5-6 illustrate the replacement of an old banner 25*o* by a new banner 25*n* by taping 15 the leading end of the new banner to the trailing end of the old banner. The old banner may be removed and the new banner installed by simply opening the end-cap flap at the unloading end of the banner display assembly and pulling the old banner longitudinally out from the banner display assembly while the trailing end of the old banner pulls the new banner into position. Once the trailing edge of the old banner is free from the horizontal rails it is un-taped and discarded.

Figure 14:
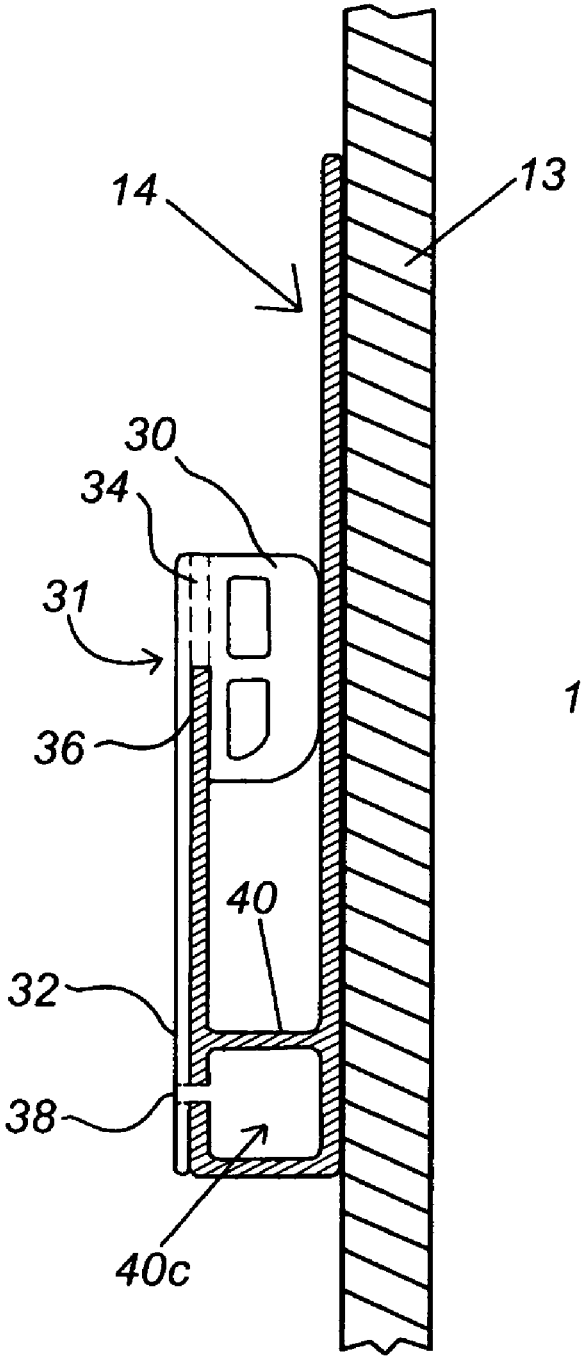
FIG. 14 is a sectional view of a section of extruded segment taken along lines 30*a*-30*a* of FIG. 11.

By modifying the number and type of slots and notches on the extruded segments, a variety of custom retention members are employed to prevent the banner from wind, excessive movement and puckering; one being a set of flexible retention cleats 30 (FIG. 12-14, 18-20) having a head part 31 with a molded channel 36 and a tail part 32 with an aperture 38 toward the bottom of the tail for fastening to a rail. The head part 31 is engaged by inserting it into one of a series of regularly spaced notches 34 along the outer lip of the horizontal rails; the bottom edge of the notch 34 mating within the molded channel 36 of the flexible retention cleat. When engaged, the head part of the flexible retention cleat applies pressure to a banner against a surface to prevent slippage and wrinkling. Disengaging the flexible retention cleats is required prior to installation of a new banner and is accomplished by pulling the head part 31 of the cleat up and out of mating position with the lower edge of a notch 34. The flexible retention cleats are preferably of silicone and deformable so that they stretch and bend readily and are affixed to the horizontal rails by a screw and washer combination to avoid tearing the silicone. FIGS. 13, 14, 20 show the deformable cleat in engaged position. FIG. 14 is a cross sectional view of FIG. 13 taken along lines 30*b*-30*b* showing the position of the deformable cleat while engaged mating with notch 34. To further illustrate the relationship of the deformable cleat to the horizontal rails; FIGS. 18 and 19 and 20 in order, show a deformable cleat 30 affixed to the top horizontal rail 10*t*' in disengaged position, a deformable cleat 30 affixed to the bottom horizontal rail 10*b*' in disengaged position, and a deformable cleat 30 affixed to the bottom horizontal rail 10*b*' in engaged position.

Other types of retention devices are shown in FIGS. 21-24; in order, they are a plan view of a dislocateable clip 33, a side profile view of dislocateable clip, a plan view of a fixed clip 35 and a side profile of fixed clip.

Similarly to the flexible cleat, the dislocateable clip 33 has a head 33*a* and tail end 33*b*, where the head end is curled back against itself producing a tang for insertion into a series of regularly spaced rectangular apertures 27 (FIGS. 25-26) along the top horizontal rail and extending the length of the entire assembly. The dislocateable clips are installed by inserting the tang of the head portion 33*a* into one of the apertures 27 where it hangs freely. The dislocateable clip is engaged by sliding the tail end 33*b* between the outer lip of bottom rail and the banner, thus applying pressure to the banner to prevent slippage and wrinkling. The dislocateable clips are shaped to have at least two points of contact with the banner. Disengaging the dislocateable clips is accomplished by pushing the tail end 33*b* up and out from between the horizontal rail and the banner while the head portion remains hanging from the notch above. As shown in FIG. 25 a pole tool 46, being a rounded pole with a foam rubber tip 47 is used to engage and disengage the dislocateable clips by pushing up and to the side of the tail end of the dislocateable clip.

Figure 1:
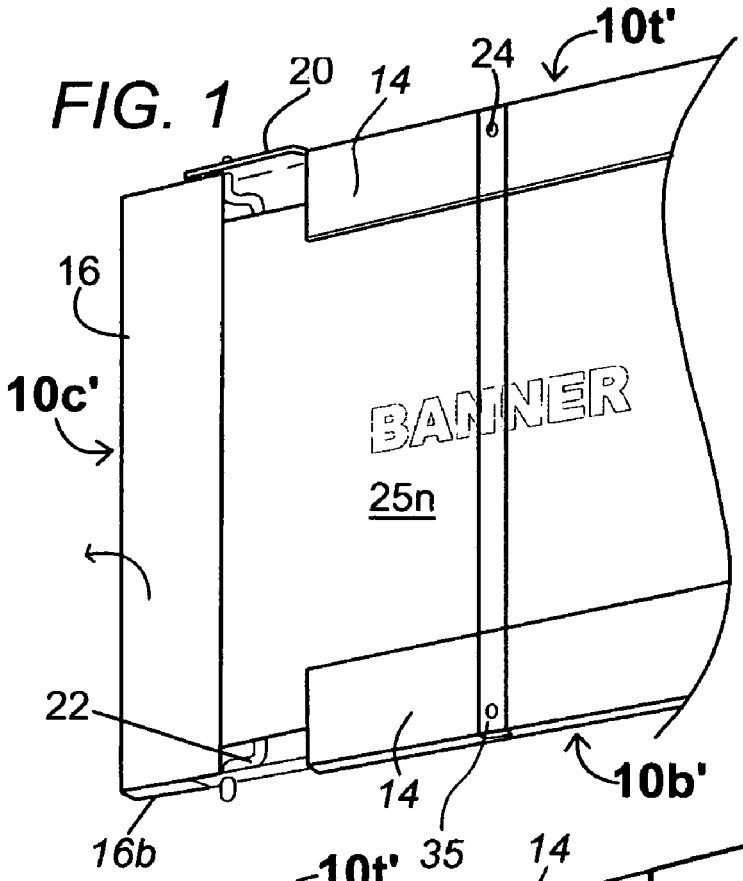
FIG. 1 is a partial perspective view of the loading end of the banner display assembly with transversely mounted fixed retention clip 35.

Another type of retention member, a fixed retention clip 35 is shown in place FIGS. 1-2 attached transversely to the horizontal rails. These retention members are permanently attached to the assembly in regular intervals, having no contact with the banner 25*n* and not requiring dislocation prior to installing or un-installing a banner.

Example

The following is presented as a non-limiting example of a method of installing the banner display assembly:

Referring to FIGS. 1-25; on site assembly of the banner display assembly is accomplished by:

I) selecting a banner display area; II) using a snap line to establish a level line on a surface; III) inserting a metal alignment pin 43 of approximately 3 inches in length, into a c-shaped joining channel 42 of a first to be installed extruded segment 14; IV) beginning with the construction of the bottom rail 10*b*, the bottom of extruded segment 14 is aligned with the snap line marking; V) once positioned, attach the initial extruded segment 14 to a given surface by inserting appropriate fastener type (screw, concrete anchor, molly bolts), or other, into the holes 24 provided for that purpose which are along the length of both the inner and outer lips of 14; VII) align additional extruded segments end to end; bottom edges of the extruded segments along the snap line marking, and sliding metal alignment pins into mating c-shaped channels 42 leaving an approximately 1.58 mm gap 44 between channel segments. In such a way, each subsequent segment is aligned with the previous segment by the alignment pins and affixed to the surface; VIII) Repeat steps (I-VII) with the construction of the top rail; IX) install vertical frame member 20 and spindle 22 vertically abutting the top and bottom rails at that end desired for loading banner rolls; X) install a first co-extruded end-cap sub-assembly over the vertical frame member by lining up the fastener positioning apertures on the base portion 16*b* of the end-cap with those on the vertical frame member, and attach to the surface; XI) install a second co-extruded end-cap sub-assembly opposite the first co-extruded end-cap sub-assembly, and attach to the surface; all parts now defining a largely rectangular frame.

The invention claimed is:

1. A rectangular frame for the containment and display of banners comprising:

a mounting surface; and, a spindle for the lengthwise insertion lengthwise through a rolled banner; and, a vertical frame member supportive of said spindle and vertically attachable to said mounting surface; and, a joining member; and, a plurality of extruded segments attached to said mounting surface, each segment having a lengthwise open channel, shaped for the insertion and lengthwise travel of a banner edge, and, each said lengthwise open channel longitudinally divided by a divider forming an enclosed channel, and, each divider defining a border between said lengthwise open channel and said enclosed channel, and a top horizontal rail and a bottom horizontal rail each formed from said plurality of segments laid end to end, fastened to said mounting surface and expandably joined to each other by said joining member; and, a first end-cap vertically attached to said mounting surface, said first end-cap having a base portion and flap portion hinge-ably connected and movable between a closed position partially occluding said vertical frame member supportive of said spindle and an open position providing access to said vertical frame member supportive of said spindle; and, a second end-cap vertically attached to said mounting surface, said second end-cap having a base portion and flap portion hinge-ably connected and movable between a closed position occluding the ends of said top and bottom horizontal rails, and an open position exposing said ends of said top and bottom horizontal rails; and, a plurality of banner retention members; and, a plurality of regularly spaced fastener positioning apertures.

2. The rectangular frame of claim 1 in which said rolled banner is supplied from a source pre-registered having no breaks in continuity.

3. The rectangular frame of claim 1 in which said plurality of regularly spaced fastener positioning apertures are along the length of said extruded segments, said vertical frame member supportive of said spindle, and said first and second end-caps.

4. The rectangular frame of claim 1 in which said joining member is a rigid pin.

5. The rectangular frame of claim 1 in which said plurality of extruded segments having a joining channel for the slideable insertion therein of said joining member.

6. The rectangular frame of claim 1 in which said plurality of extruded segments having a substantially "J" shaped outer profile, having a longer lip attached to said surface and a shorter outer facing lip.

7. The rectangular frame of claim 1 in which said spindle is removable from said vertical frame member attachable to said spindle.

8. The rectangular frame of claim 1 in which one end of said spindle is joined to said vertical frame member supportive of said spindle.

9. The rectangular frame of claim 1, in which each of said base and a flap portions are releasably maintained in said closed position by a pair of magnetically attractive members, each member of said pair of magnetically attractive members affixed to said base and flap respectively.

10. The rectangular frame of claim 1, in which each of said first and second end-caps are co-extruded.

11. The rectangular frame of claim 1, in which said banner is releasably retained between said base and a flap portions of said first and second end-caps while in closed position.

12. The rectangular frame of claim 1, said horizontal top and bottom rails having a series of regularly spaced notches and slots for the insertion of a plurality of banner retention members.

13. The rectangular frame of claim 1, in which said plurality of banner retention members is taken from at least one of the following; removable clip, dislocateable clip, fixed clip, dislocateable cleat, transversely mounted strap.

14. The banner holder of claim 1, in which said plurality of banner retention members are deformable.

15. The banner holder of claim 1 in which said plurality of banner retention members are made of a transparent material.

16. The banner holder of claim 1 in which said second end-cap is opened to slide-ably expel said banner.

17. A method for the installation and replacement of ad banners from a rectangular banner display having two horizontal rails with inner channels, a frame member supportive of a spindle, a spindle supportive of an ad banner, a first open-able vertical end-cap for the loading of a banner, a second open-able vertical end-cap for the unloading of a banner, and a plurality of fixed and dislocateable banner retention members; said method comprising the steps of:

a) accessing said spindle of said banner display by moving said first vertical end-cap to said open position and, b) placing a rolled new ad banner over said spindle and, c) taping the leading edge of said new ad banner to the trailing edge of a previously installed banner and, d) disengaging said banner retainers where dislocateable and, e) opening unloading end-cap to expose said inner channels of said horizontal rails and, f) expelling said previously installed ad banner by pulling leading edge of said previously installed ad banner longitudinally along said inner channels of said horizontal rails and over said second end-cap and, g) un-taping said trailing edge of a previously installed ad banner from said leading edge of new ad banner and discarding said previously installed ad banner and, h) closing said second end-cap to secure said new banner and prevent further longitudinal travel and, i) reengaging plurality of banner retainers where dislocateable.

* * * * *